US006804906B1

(12) United States Patent
Olsen

(10) Patent No.: US 6,804,906 B1
(45) Date of Patent: Oct. 19, 2004

(54) LOCKABLE FIREARM SAFETY DEVICE

(75) Inventor: Charles A. Olsen, Milford, CT (US)

(73) Assignee: The Marlin Firearms Company, North Haven, CT (US)

( * ) Notice: Subject to any disclaimer, the term of this patent is extended or adjusted under 35 U.S.C. 154(b) by 0 days.

(21) Appl. No.: 10/452,263

(22) Filed: Jun. 2, 2003

(51) Int. Cl.[7] ..... F41A 17/42
(52) U.S. Cl. ..... 42/70.11
(58) Field of Search ..... 211/64; 42/70.11

(56) References Cited

U.S. PATENT DOCUMENTS

| | | | | |
|---|---|---|---|---|
| 3,802,612 | A | 4/1974 | Smith | 224/1 R |
| 4,364,499 | A | 12/1982 | McCue | 224/42.45 R |
| 4,624,372 | A | 11/1986 | Brolin | 211/4 |
| 4,696,405 | A | 9/1987 | Waring | 211/4 |
| 4,747,280 | A | 5/1988 | Shaw | 70/279 |
| 5,020,259 | A | 6/1991 | Mossberg | 42/70.11 |
| 5,153,360 | A | 10/1992 | Upton | 42/70.11 |
| 5,400,538 | A | 3/1995 | Shannon | 42/70.07 |
| 5,438,787 | A | 8/1995 | McMaster et al. | 42/106 |
| 5,446,988 | A | 9/1995 | Frederick, Jr. | 42/70.11 |
| 5,524,772 | A | 6/1996 | Simmons | 211/4 |
| 5,551,181 | A | 9/1996 | Upton | 42/70.11 |
| 5,676,257 | A | 10/1997 | Adkins | 211/4 |
| 5,680,723 | A | 10/1997 | Ruiz | 42/70.11 |
| 6,382,002 | B1 | 5/2002 | Chen | 70/202 |
| 6,568,117 | B2 | 5/2003 | Weinraub | 42/70.11 |
| 2002/0162265 | A1 | 11/2002 | Abad | 42/70.11 |

*Primary Examiner*—Jack Keith
*Assistant Examiner*—Troy Chambers
(74) *Attorney, Agent, or Firm*—Alix, Yale & Ristas, LLP

(57) ABSTRACT

Disclosed is a lockable safety device for use with a firearm. The device comprises an elongated body with opposing large and small ends. The small end is inserted through the firearm receiver and secured external to the firearm receiver. The large end is sized to prevent movement through the firearm receiver. The small end is configured to accommodate a locking device. When the device is engaged with a firearm, access to, and use of, the firearm is restricted.

7 Claims, 4 Drawing Sheets

LOCKABLE FIREARM SAFETY DEVICE

BACKGROUND OF THE INVENTION

This invention relates generally to safety devices that are removable from, but selectively securable to, a firearm to prevent discharge of the firearm by unauthorized users.

The use of locking mechanisms, including electronic devices, to prevent discharge of a firearm by unauthorized persons is commonplace and a wide variety of devices and techniques have been advanced. The majority of such devices either interfere with the trigger or firing mechanism to prevent discharge of the firearm by an unauthorized user. These devices generally are not directed to preventing loading or unloading of ammunition in the firearm on which they are used.

Cable type firearm locking devices are also known. Such devices have a cable with one free end and an opposing end permanently attached to a locking head. These devices require a user to thread the cable free end into a first aperture in the firearm receiver, through the receiver to a connected second aperture and double the cable free end back to the locking head to render the firearm incapable of discharge. It can be difficult to double the cable and secure the cable free end in the locking head. The use of a permanently attached locking head is also disadvantageous in that it limits locking options available to a user.

SUMMARY OF THE INVENTION

Briefly stated, the invention in a preferred form comprises an elongated body having a small end and an opposing large end. The small end and body are configured to allow insertion into a firearm receiver port, movement through the receiver and exit from another firearm receiver port. The small end defines a locking aperture therein. The large end is configured to prevent movement through the firearm port or receiver. In one variation of the invention, the large end comprises arms radially projecting from the body edges. In another variation of the invention the safety device comprises a one piece, rigid, elongated body curved along a longitudinal axis.

The inventive device is robust in construction, yet owing to simplicity of design it can be produced economically. The inventive device can be easily and rapidly installed and removed by a user without tools. The safety device includes provisions for use with known locking devices to releasably secure the safety device to the firearm.

The inventive safety device when disposed in a firearm can provide a tactile confirmation that the firearm is incapable of firing. In some variations the inventive safety device when installed in a firearm can also provide visual confirmation that the firearm is incapable of firing even at a distance from the firearm.

An object of the invention is to provide a new and improved separable lockable safety device for a firearm.

Another object of the invention is to provide a new and improved firearm safety device for use with existing locking devices that has an efficient construction and which can be readily installed to, and removed from, a firearm without tools.

BRIEF DESCRIPTION OF THE DRAWINGS

Other objects and advantages of the invention will become apparent from the specification and the drawings in which.

DETAILED DESCRIPTION OF THE PREFERRED EMBODIMENT

Figures 4, 5:
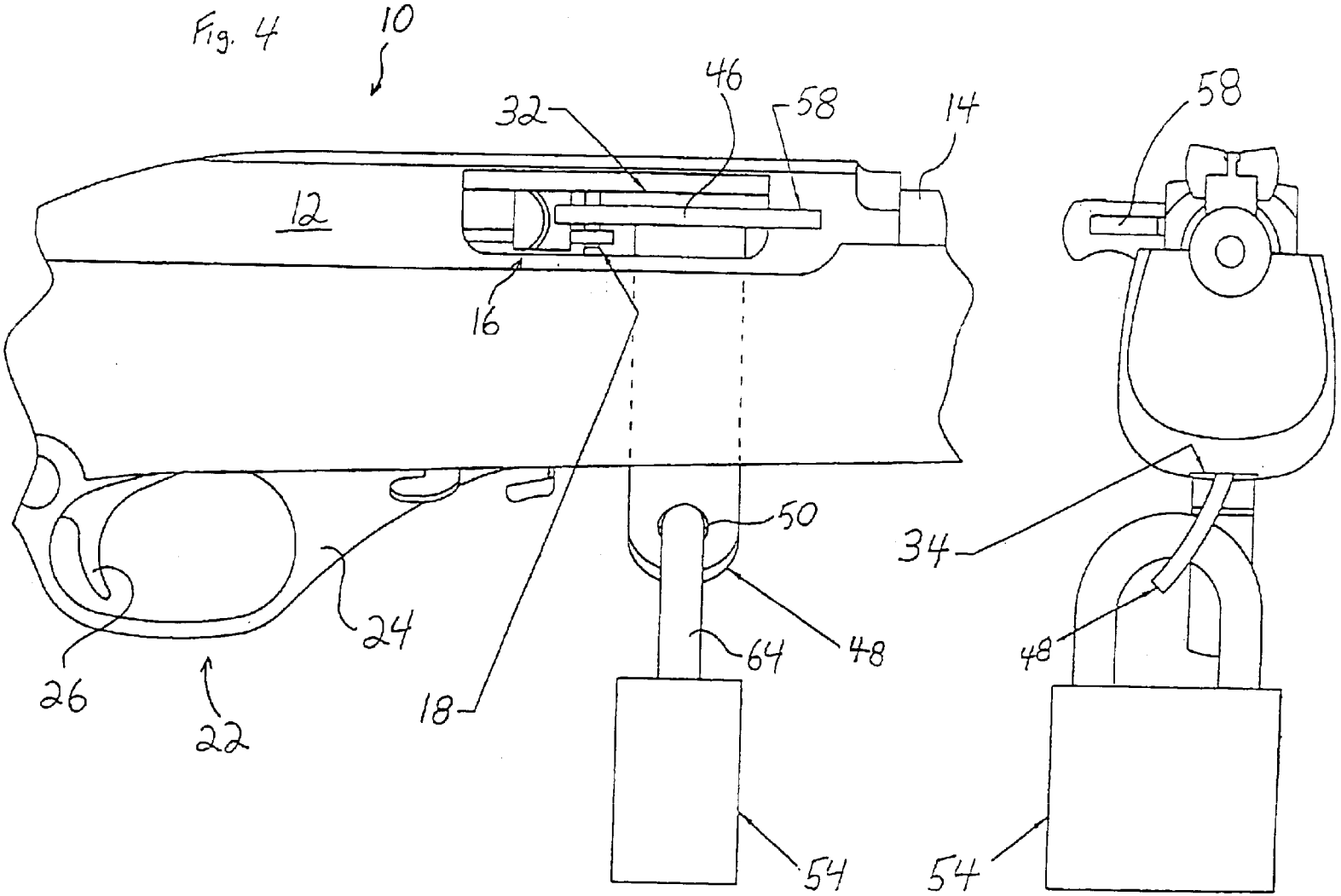
FIG. 4 is a side view of the firearm safety device of FIG. 1, partly in phantom, disposed in a firearm, shown broken away, and secured thereto with a conventional locking device.
FIG. 5 is a front view of the firearm safety device of FIG. 1 disposed in a firearm and secured thereto with a conventional locking device.

It should be understood that while the inventive firearm safety device is shown and described in some of the figures with relation to a rifle having a self-loading or bolt type action for clarity, the invention has application with many types of firearms, including rifles and shotguns, and many types of firearm actions, including self-loading, pump and bolt types. With reference to the drawings wherein like numerals represent like parts throughout the several figures, as shown in FIG. 4, a firearm 10 typically comprises a receiver or frame 12 to which a barrel 14 is mounted. The receiver 12 includes an action or mechanism 16 that must be completely cycled for the firearm to be discharged. Typically, the action cycle comprises loading an unfired cartridge from an integral or separable magazine into a chamber, securing the unfired cartridge within the chamber, as with a breech block 18, firing the loaded cartridge, extracting the fired cartridge from the chamber and ejecting the fired cartridge from the firearm. As used herein, a breech block 18 encompasses any part of a firearm mechanism for closing the rear of a chamber against the force of a discharging cartridge and includes breech bolts.

The receiver 12 defines a firearm longitudinal axis that is generally parallel to the barrel 14. A trigger guard assembly 22 includes a trigger guard 24 housing a trigger 26. The trigger guard assembly 22 is mounted to the underside of the receiver 12 in line with the firearm longitudinal axis. The trigger 26 is pivotally mounted to the receiver 12 or trigger guard 24 and substantially disposed within the trigger guard 24 when the firearm 10 is in condition to be discharged. The trigger 26 is pulled rearward in a conventional fashion to actuate a firing mechanism and discharge the firearm 10.

The firing mechanism may employ a pivoting hammer that cooperates with a firing pin, a striker assembly, or other well-known firing mechanisms. Actuation of the trigger 26 functions to release the mechanism to propel the firing pin into contact with the primer of a cartridge housed within the chamber. Contact of the firing pin with the primer generates sufficient energy to explode a primer mixture and ignite a propellant mixture within the cartridge. Combustion of the propellant mixture generates sufficient pressure to discharge a bullet from the barrel.

Figure 10:
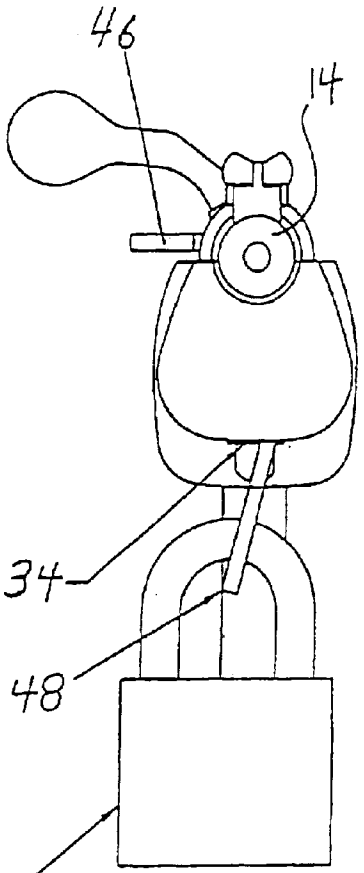
FIG. 10 is a front view of the firearm safety device of FIG. 6 disposed in a firearm and secured thereto with a conventional locking device.

The receiver 12 defines an ejection port 32 for ejection of a fired cartridge and a loading port 34 for loading ammunition into the firearm. As is known in the art, the ejection 32 and loading 34 ports may be defined in different positions in the receiver 12. For example, the ejection 32 and loading 34 ports may each be located at any of the top, bottom and/or sides of the receiver. In the embodiment shown in FIG. 4 the ejection port 32 is located in the receiver side and the loading port 34 is located in a magazine well defined in the receiver bottom and shown in FIG. 5. In the embodiment shown in FIG. 9 the ejection port 32 is located in the receiver top and the loading port 34 is located in a magazine well defined in the receiver bottom and shown in FIG. 10.

Figure 3:
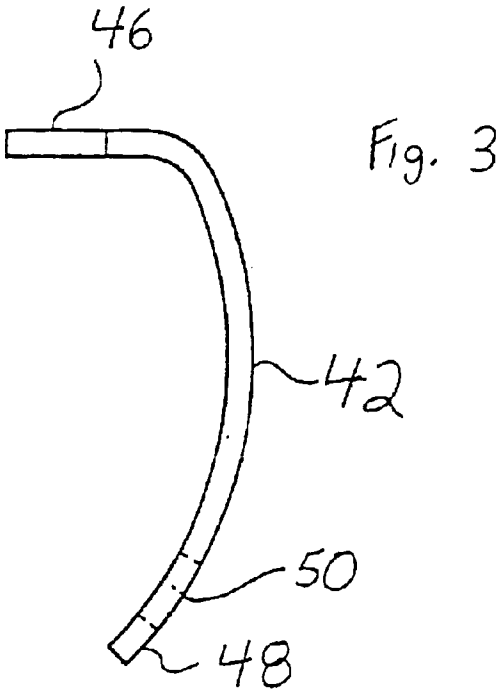
FIG. 3 is an end view, partly in phantom, of the firearm safety device of FIG. 1.
Figure 1:
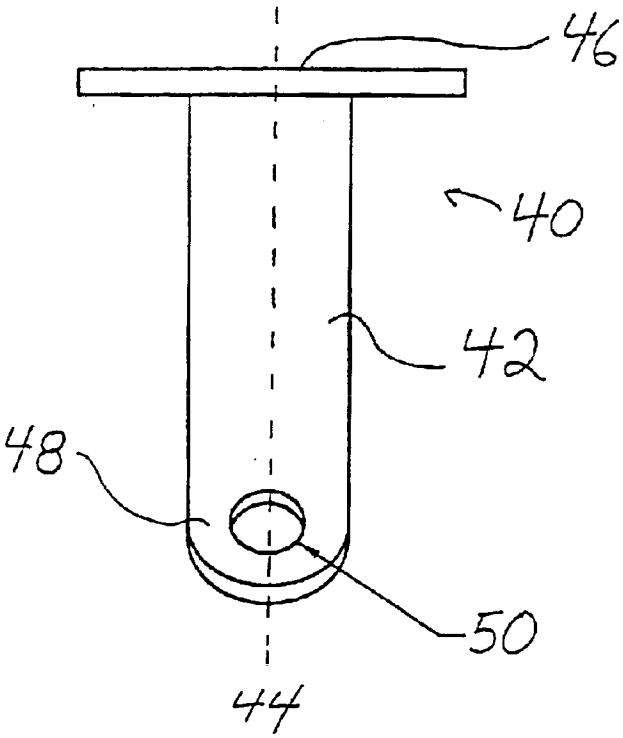
FIG. 1 is a side view of one embodiment of a firearm safety device.
Figure 8:
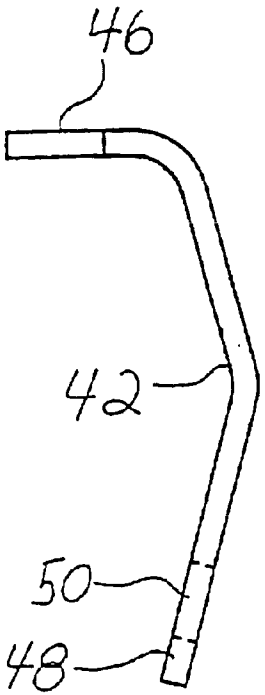
FIG. 8 is an end view, partly in phantom, of the firearm safety device of FIG. 6.
Figure 7:
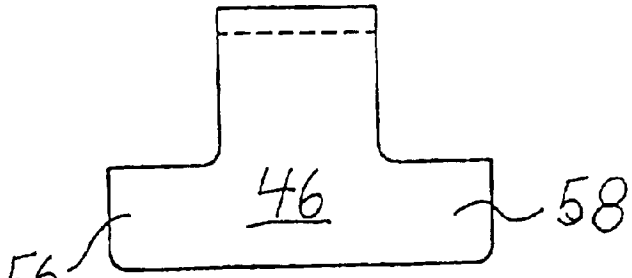
FIG. 7 is a top view, partly in phantom, of the firearm safety device of FIG. 6.
Figure 6:
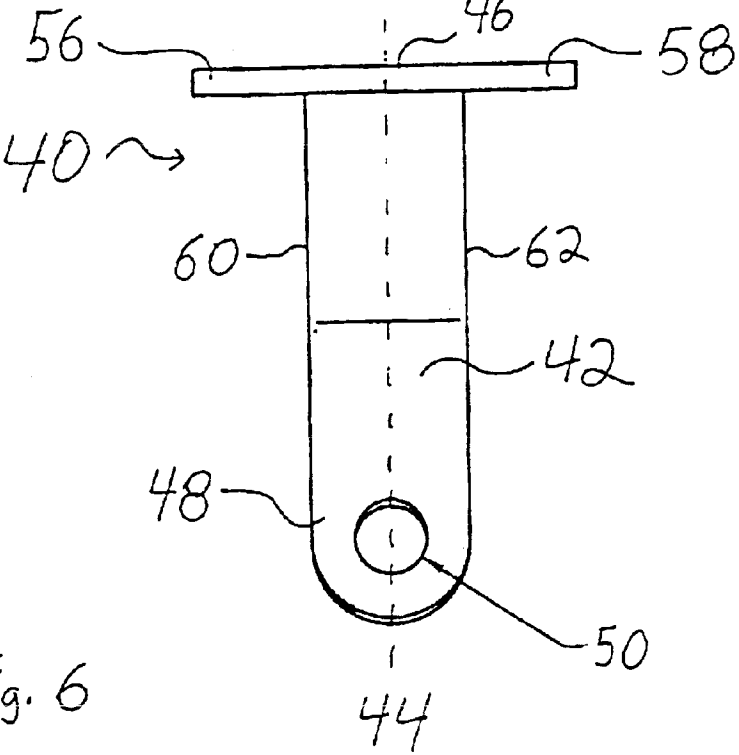
FIG. 6 is a side view of another embodiment of a firearm safety device.

With reference to the embodiments illustrated in FIGS. 1 and 6, the inventive firearm safety device 40 comprises an elongated body 42 defining a longitudinal axis 44 and having longitudinally spaced ends 46, 48. One of the ends 46 is larger and the other end is smaller 48. The body 42 may be curved along the longitudinal axis 44 as shown best in FIGS. 3 and 8 to allow movement through an interior cavity of the firearm receiver 12. As used herein, the term curved encompasses a smooth radius curve as shown best in FIG. 3 as well as a bend as shown best in FIG. 7.

The small end 48 is configured to allow insertion through firearm ports 32, 34 and the interior cavity of a firearm receiver 12. The small end 48 defines a locking aperture 50 therein. The locking aperture 50 is configured to retain a conventional locking device 54 such as a combination or keyed padlock (as shown in FIGS. 4 and 5).

Figure 2:
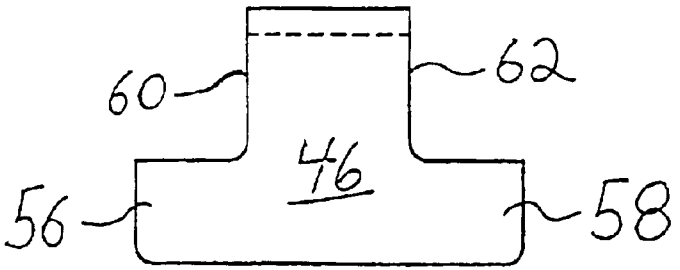
FIG. 2 is a top view, partly in phantom, of the firearm safety device of FIG. 1.

The large end 46 is configured to prevent movement through the firearm port 32 or the interior cavity of a firearm receiver 12. This configuration can be accomplished by, for example, bending or twisting the large end 46. The large end 46 is advantageously comprised of projecting, radially opposed arms 56, 58. In one advantageous embodiment for a rifle shown in FIG. 2 each arm 56, 58 projects orthogonally to the longitudinal axis 44 and from an opposing body edge 60, 62 to form a T shape as shown in FIGS. 1 and 6. The width of the large end 46 in this preferred embodiment is approximately two times the width of the body small end 48. Advantageously the body 42 and arms 56, 58 are formed as a rigid, one piece structure.

Typically, the inventive safety device 40 is comprised of metal and may be hardened to further increase rigidity and strength. Surface hardened low carbon steel is believed to be suitable for this application. Other materials such as, for example, polymers or polymer composites can be used if the strength of a metal safety device is not needed or desired.

The inventive safety device 40 can be covered with a protective coating such as, for example, plastic or elastomer to lessen or prevent scratching of the firearm finish. If the coating is a readily visible color such as yellow or orange, then installation of the inventive safety device within the firearm can be readily confirmed visually and at a distance.

The use of hardened metal provides a safety device that is advantageously rigid and resistant to bending under use. As used herein, a rigid safety device is not capable of folding or appreciably bending under the normal manipulation of a user.

In a less preferred embodiment of the invention the body is a flexible member. As used herein, a flexible member has the ability to be readily rolled or folded by a user under normal manipulation. The safety device of this embodiment also comprises a small end defining a locking aperture and a longitudinally opposed large end.

Figure 9:
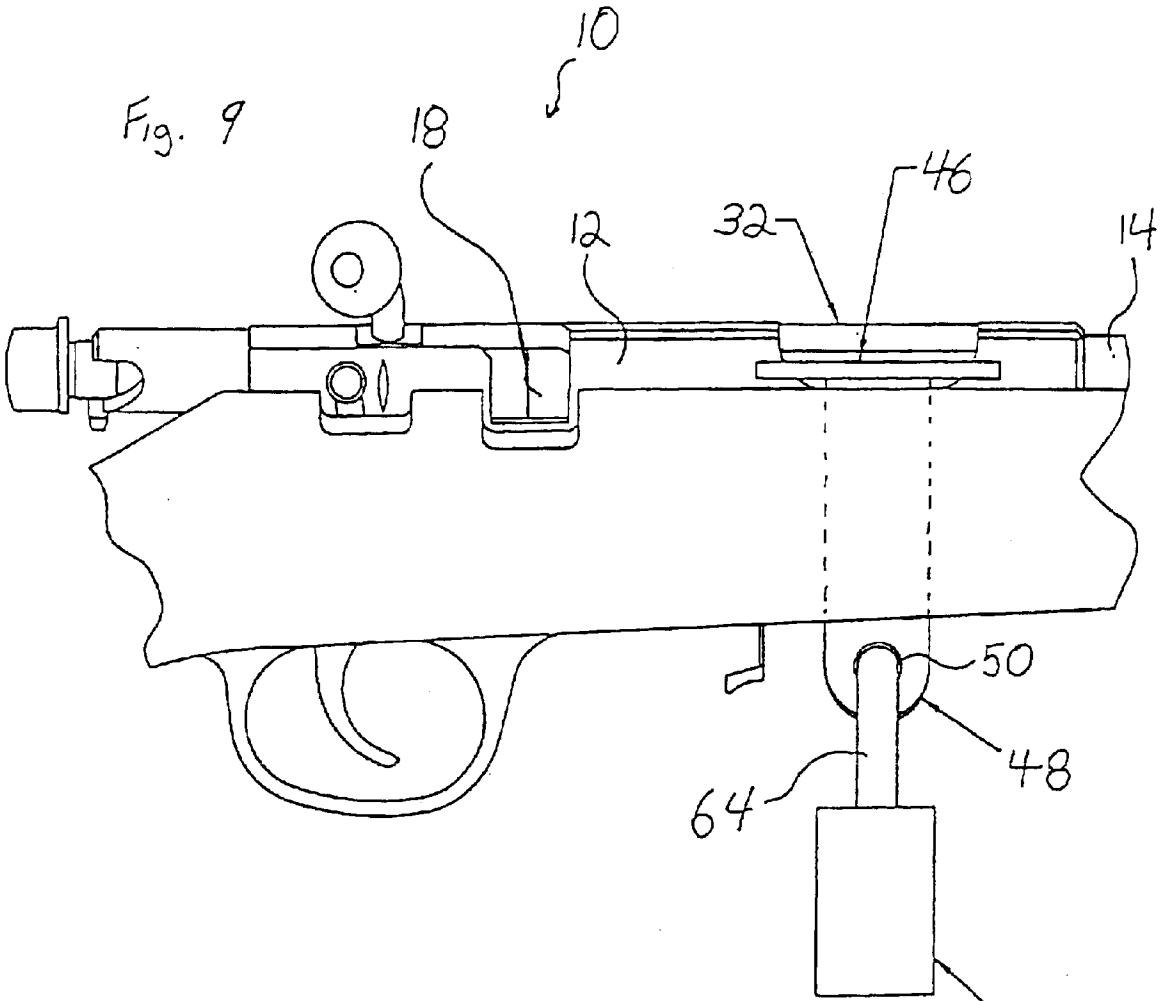
FIG. 9 is a side view of the firearm safety device of FIG. 6, partly in phantom, disposed in a firearm, shown broken away, and secured thereto with a conventional locking device.

In use, the firearm magazine is removed and the breech bolt 18 is displaced from the fire position toward the open position shown best in FIG. 4 or 9 to remove any loaded ammunition. The safety device small end 48 is inserted through a receiver port 32, through a receiver internal cavity and out of the receiver magazine well 34. At this time the safety device large end 46 is external to the receiver first port 32 and the locking device small end aperture 50 is external to the receiver magazine well 34. A shackle 64 from a separate locking device 54 is secured to the small end locking aperture 50. In this condition the safety device large end 46 prevents movement of the safety device 40 through the first port 32 and the locking device 54 prevents movement of the safety device 40 out of the receiver 12 in the opposite direction. The safety device small end 48 can also be inserted through the magazine well 34, through the receiver internal cavity and out of receiver port 32. With the inventive safety device 40 locked to the firearm it is not possible to place a magazine in a magazine well, or load ammunition into the chamber or displace the breach block to the fire position. Since ammunition must be loaded into the chamber and the breach block displaced to the fire position for firearm use, the secured safety device prevents unauthorized users from loading and discharging the firearm.

To remove the safety device 40 and ready the firearm 10 for use, the locking device 54 is removed from the small end locking aperture 50 and the small end 48 is retracted through the magazine well 34, receiver cavity and out the first port 32. At this point the safety device 40 is completely removed from the firearm 10 which can now be loaded, cycled and fired.

The use of a conventional locking device 54 with the inventive safety device 40 is advantageous in that it permits a user to secure firearms 10 with existing locks, thereby lowering the cost of the safety device. Additionally, the use of a conventional locking device 54 with the inventive safety device 40 allows a user the choice of securing the firearm with mechanical key locks, mechanical combination locks, magnetic or electronic key locks, electronic combination locks, etc. Further, the locking device can easily be changed. A plurality of inventive safety devices can also easily be secured with a respective plurality of locking devices, each locking device responsive to the same key or combination.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A safety device to prevent use of a longarm having a receiver defining first and second ports connected by an internal cavity containing a breech block displaceable from a fire position, the device comprising:

a one piece, rigid, elongated body curved along a longitudinal axis and having a first end defining an aperture and a longitudinally opposed second end, the first end and body having a width smaller than the ports and the internal cavity and the second end having opposing arms, each arm extending from a body side edge, the arms having a width greater than the first port and the internal cavity; and a locking device separable from the body and securable to the first end aperture but free of the second end when secured to the first end aperture;

wherein the first end and body are disposable in an insertion direction through the first longarm port, into the internal cavity and out of the other port so that the breech block is displaced from the fire position, the opposing arms remaining external to the first port and preventing movement of the safety device through the longarm receiver in the insertion direction and the secured locking device adjacent the second port and preventing removal of the safety device through the longarm receiver.

2. The safety device of claim 1 wherein the receiver comprises a top and a bottom connected by opposing sides and the first port is an ejection port defined in one of the receiver sides and the second port is a magazine well defined in the receiver bottom and wherein the first end and body are disposable in an insertion direction through the ejection port and out of the magazine well.

3. The safety device of claim 1 wherein the receiver comprises a top and a bottom connected by opposing sides and the first port is an ejection port defined in the receiver top and the second port is a magazine well defined in the receiver bottom and wherein the first end and body are disposable in an insertion direction through the ejection port and out of the magazine well.

4. The safety device of claim 1, wherein each arm extends from a body side edge to define a fixed T shape.

5. A safety device to prevent use of a longarm having a receiver defining first and second ports connected by an internal cavity containing a breech block displaceable from a fire position. the device comprising:

a one piece, rigid, elongated body curved along a longitudinal axis and having a first end defining an aperture and a longitudinally opposed second end, the first end and body having a width smaller than the ports and the internal cavity and the second end having opposing arms, each arm extending from a body side edge to define a fixed T shape, the arms having a width greater than the first port and the internal cavity; and a locking device separable from the body and securable to the first end aperture but free of the second end when secured to the first end aperture, wherein the locking device is a padlock comprising a shackle;

wherein the first end and body are disposable in an insertion direction through the first longarm port, into the internal cavity and out of the other port so that the breech block is displaced from the fire position, the opposing arms remaining external to the first port and preventing movement of the safety device through the longarm receiver in the insertion direction and the secured locking device adjacent the second port and preventing removal of the safety device through the longarm receiver.

6. A method of securing a firearm from unauthorized use, comprising:

providing a firearm having a firearm receiver, the firearm receiver defining a longitudinal axis, a first port and a second port, the second port radially arranged around the firearm longitudinal axis from the first port, the first and second ports connected by an internal cavity, the internal cavity containing a breech block displaceable from a fire position to a load position;

providing a locking bar comprising an elongated body defining a curved longitudinal axis and having a first end defining an aperture and a longitudinally opposed second end, the first end and body having a small width, the second end having opposing arms, each arm extending from a body side edge in a direction orthogonal to the body to define a T shape, the arms having a width greater than the small width;

moving the breech block away from the fire position toward the load position;

moving the locking bar first end in an insertion direction through the first port into the internal cavity and out of the second port, wherein the locking bar second end remains external to the firearm receiver and adjacent the first port; and securing a locking device to the locking bar first end aperture adjacent to the second port and external to the firearm receiver;

wherein the locking bar arm width prevents movement of the locking bar second end through the receiver in the insertion direction and the locking device prevents movement of the locking bar first end through the receiver in a removal direction.

7. The method of claim 6, wherein the locking bar body is rigid, one piece metal structure.

* * * * *